United States Patent [19]

Wendt

[11] 4,381,575

[45] May 3, 1983

[54] SQUEEGEE/SPONGE DEVICE WITH DUAL DUROMETER

[75] Inventor: Jon R. Wendt, Mt. Prospect, Ill.

[73] Assignee: Greenview Manufacturing Company, Chicago, Ill.

[21] Appl. No.: 307,733

[22] Filed: Oct. 2, 1981

[51] Int. Cl.[3] ..... A47L 1/08

[52] U.S. Cl. ..... 15/121; 15/244 R; 15/245

[58] Field of Search ..... 15/121, 244 R, 245, 15/117, 118

[56] References Cited

U.S. PATENT DOCUMENTS

| | | | |
|---|---|---|---|
| 2,658,218 | 11/1953 | Carreiro | 15/121 X |
| 2,672,638 | 3/1954 | Blum | 15/121 X |
| 3,116,506 | 1/1964 | Browne et al. | 15/250.36 |
| 3,724,017 | 4/1973 | Mallory | 15/121 |
| 3,789,451 | 2/1974 | Laitner | 15/121 X |
| 3,968,535 | 7/1976 | Nichols | 15/121 X |

FOREIGN PATENT DOCUMENTS

| | | | |
|---|---|---|---|
| 221625 | 9/1957 | Australia | 15/121 |

*Primary Examiner*—Chris K. Moore

*Attorney, Agent, or Firm*—Silverman, Cass & Singer, Ltd.

[57] ABSTRACT

A combination cleaning device is comprised of an elongate body formed of an integral extrusion of synthetic resinous material which generally defines three planes; one plane forming a squeegee blade, a second plane having a sponge platform and a sponge attached thereto and a connecting portion, with a handle secured thereto.

2 Claims, 3 Drawing Figures

FIG. 1
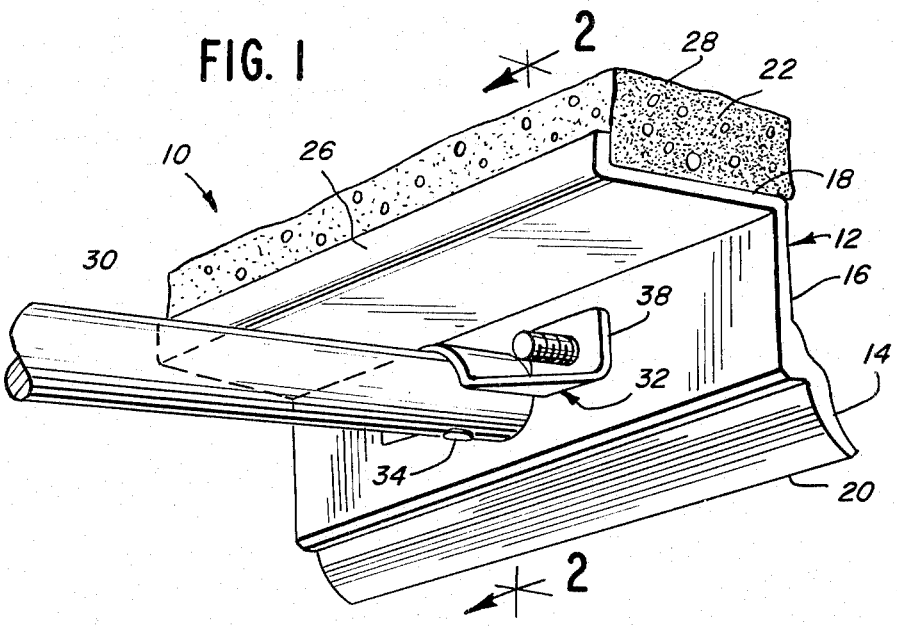
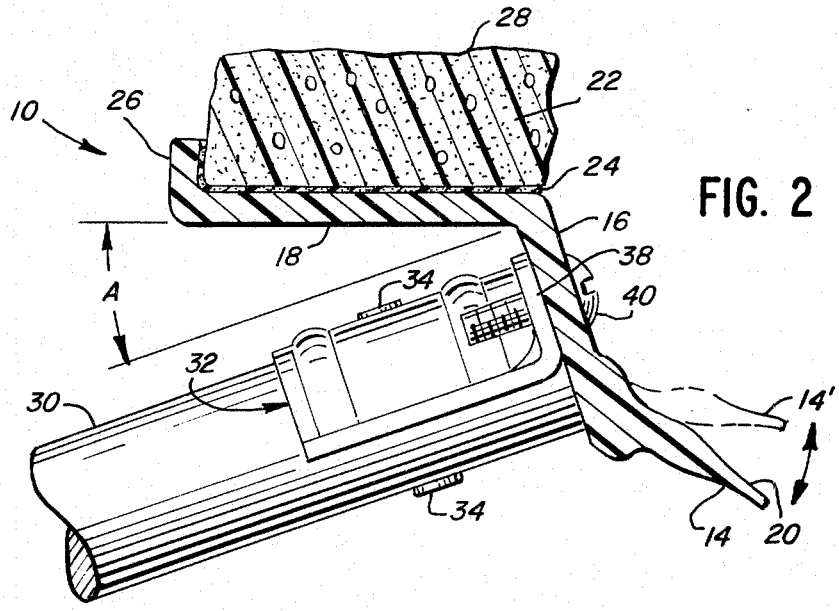
FIG. 2
FIG. 3
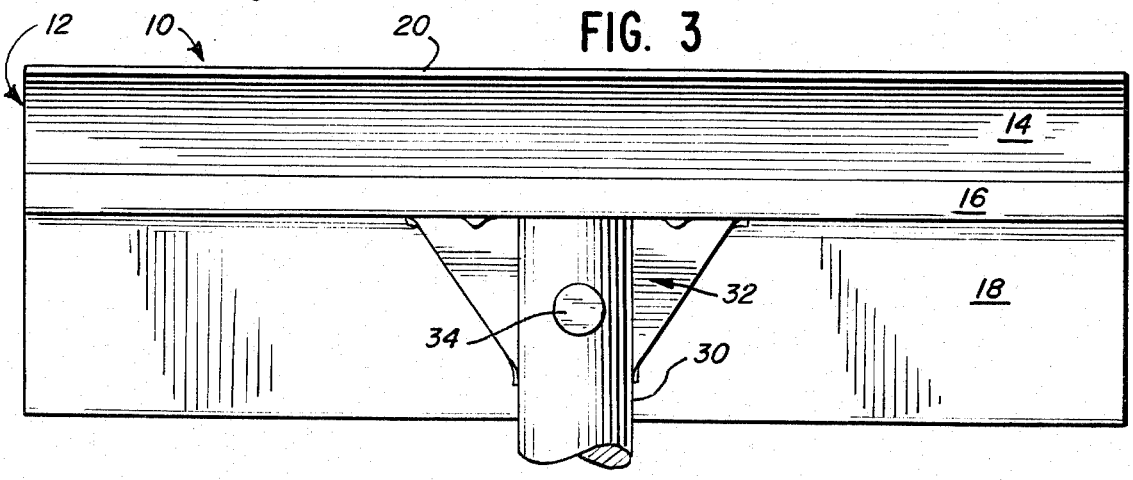

SQUEEGEE/SPONGE DEVICE WITH DUAL DUROMETER

BACKGROUND OF THE INVENTION

The present invention relates to a device for cleaning planar surfaces such as windows and, in particular, relates to a combination device providing a sponge and a squeegee attached to a frame that is connected to a handle.

Such combination sponge-squeegee devices are well-known and have been proven to be most useful in washing windows in such as cars, homes and the like. The sponge is designed to carry liquid, such as soapy water for cleaning windows and generally presents a rough or abrasive surface to assist in the cleaning process. A flexible elastomeric or similar blade is formed along one edge of the device to provide a squeegee for removing the dirty, soapy water from the window. The sponge and squeegee usually are disposed along opposite margins of the device with a handle connected with and extending from the central portion of the device.

Several devices are known which have this or similar configurations. U.S. Pat. No. 4,107,812 to Lantto discloses a structure in which there is a blade and sponge attached to an elongated holder by way of T-shaped protrusions and recesses. A rod-like handle extends from the holder.

U.S. Pat. No. 3,837,747 to Seymore discloses a washer/squeegee in which separate squeegee and sponge members are attached to a holder by way of protrusions and recesses. The handle forms a fluid reservoir. U.S. Pat. No. 3,656,202 to Paton discloses a sponge/squeegee combination in which the squeegee is sandwiched between the sponge and sponge platform and projects therefrom sufficiently for enabling removal of the dirty water.

U.S. Pat. No. 3,526,918 to Leland discloses a device wherein the squeegee blade is attached to one side of the sponge and a wire handle extends through a central plane of the sponge. U.S. Pat. No. 2,886,839 to Leopoldi discloses a resilient water bottle having a squeegee blade and a sponge disposed along opposite sides thereof. U.S. Pat. No. 2,715,745 to Jacobsen discloses a sponge having a squeegee blade, cemented to or integrally molded therewith, along one edge. No handle is provided.

These devices generally require the assembly of several different pieces and because of the geometry of these pieces, the assembly is normally effected by hand.

The present invention provides a device which lends itself to automatic formation of the squeegee and sponge platform and facilitates assembly of the sponge and handle thereto. The number of pieces involved results in great economy compared with prior devices of this type. In addition the article is more robust than prior device because there are no fasteners in the body of the squeegee to corrode or get loose.

SUMMARY OF THE INVENTION

A device is provided which is fabriated of a minimum number of parts. A main body or support is formed as a multiple durometer integral extrusion of synthetic resin having a flexible edge functioning as a squeegee blade, a central connecting portion and a sponge securing platform opposite the squeegee edge. The central connecting portion and sponge securing platform are rigid, but the entire body is extruded through a single die by known techniques, the resulting member being cut to length. A sponge is cemented to the platform and a conventional handle is secured to the central portion.

BRIEF DESCRIPTION OF THE DRAWINGS

FIG. 1 is a perspective view of the device providing a sponge, squeegee and handle constructed and arranged in accordance with the invention;

FIG. 2 is a fragmentary sectional view of the device taken generally along the lines 2—2 of FIG. 1 and in the direction illustrated by the arrows; and FIG. 3 is the bottom plan view of the device.

DESCRIPTION OF THE PREFERRED EMBODIMENT

In accordance with the invention there is provided a device constructed and arranged to present a sponge and squeegee blade on a rod-like handle. In one position the sponge may be brought to bear against a planar surface to be cleaned such as a car window and in another position the device is rotated about 180° for use of the squeegee to remove dirty water from the pane of glass.

This device is indicated generally by the reference character 10. The device comprises an elongated body 12 providing a squeegee blade 14, a central connecting portion 16 and a sponge platform 18 all integral with one another and formed as an extrusion.

This body 12 generally defines three planes at different angles, each of the elements comprising the squeegee blade, the central connecting portion and the sponge platform generally defining a respective one of said planes. The body 12 is formed as a length of an extrusion of resinous plastic material. The extrusion is cut into any desired length. The character of the plastic of the body 12 may be termed as having a "dual-durometer" because of the difference in rigidity or stiffness between two parts of the same integral member.

Body 12 is formed as a unitary extrusion to provide a durometer for the squeegee blade 14 which is about 60 on a shore A2 scale. Typically, squeegee blades have a durometer which is from about 50 to 70.

The remainder of body 12 is formed of a material having a much higher durometer number of $80\pm3$ on a shore D scale which is relatively hard as compared to the squeegee blade and therefore is more rigid. In the preferred embodiment the body 12 is formed of polyvinyl chloride having different durometers for the squeegee blade and the remainder of the body.

Squeegee blade 14 is a narrow, flat structure of tapered cross-section, which is extruded as a unit with connecting portion 16 and presents a wiping edge 20. Referring to FIG. 2, squeegee blade 14 is soft and may be distorted to a position indicated by the phantom lines at 14'.

Sponge platform 18 is a broad, flat elongated structure also extruded as a unit with connecting portion 16. A sponge element 22 is fastened to one side of platform 18 by way of a cement or adhesive 24. Platform 18 terminates connecting portion 16 in a lip or flange 26 which aids in registration of sponge 22 on the platform 18 during the fastening operation.

Platform 18 forms an angle A with a plane normal to the plane of central portion 16. Angle A is typically 15 degrees to provide the proper working angle for sponge 22 on a pane of glass while the device 10 is being held by the user. Sponge 22 is formed of a foamed plastic material which commercially available and which is known in the trade as polyfoam. Sponge 22 provides the moisture supply for the window washing operation and may include a soft abrasive applied to or integrally formed with sponge 22 on a face 28 thereof.

Device 10 further includes a handle 30 fastened to frame 12 at connecting portion 16. Handle 30 is normal to the longitudinal axis of body 12 and comprises a simple wooden rod. Handle 30 is fastened to body 12 through the intermediate of a bracket 32. Bracket 32 is fastened to handle 10 by means of a rivet 34 (FIGS. 1 and 3) which passes through the diameter of handle 30 and the thickness of bracket 32. Bracket 30 includes two flanges 38, (FIGS. 1 and 2) fastened to connecting portion 16 by fasteners such as screws 40. In a preferred embodiment, handle 30 is made of wood and bracket 32 is made of metal which has been stamped to provide the desired geometry to mate the handle 30 with the connecting portion 16.

Thus, it may be visualized that the combination squeegee and sponge device may be grasped by the handle 30 and used in one position to apply soapy water to a pane of glass to wash the same. Thereafter, the device may be rotated around the axis defined by handle 30 about ½ term to bring the wiping edge 20 or squeegee blade 14 against the pane to remove the dirty water from the pane of glass.

Moreover, the geometry or cross-section of body 12 lends itself to the extrusion of long members which are cut to provide the individual lengths of body 12.

For example, one embodiment may be that of the sponge carrying platform 18 having a width of about 1 ⅜", connecting member 16 having a width of about 9/16 of an inch, and squeegee blade 14 having a width of about ½" with body 12 having a section of about 3/32" of an inch in thickness.

Modifications and variations of the present invention are possible in light of the above teachings. For example, the precise angles described herein for the squeegee blade and sponge carrying platform may be modified as desired to facilitate the cleaning operation. The material of the body 12 may be changed as desired and so may the material of handle 30. The durometer numbers of the material forming the frame 12 may be modified, but this is believed to be within the scope of the invention. It is therefore to be understood that within the scope of the apended claims, the invention may be practiced otherwise than as is specifically described.

What is claimed and desired to be secured by Letters Patent of the United States is:

1. A device comprising:

an elongated body which generally defines three planes: a generally planar squeegee blade, an opposed planar sponge carrying platform and a planar, central connecting portion, the body being formed of an extruded unitary member of synthetic resinous material cut to a desired length and the material of the squeegee blade being flexible while the material of the connecting portion and sponge carrying platform is relatively rigid;

an elongate sponge member fastened to the sponge carrying platform; and a handle secured to the central connecting portion.

2. The device as claimed in claim 1 in which the edge of the sponge carrying platform opposite the connecting portion 16 provides a lip to aid in registering the sponge member on the platform during assembly to the platform.

* * * * *